US011585617B2

(12) United States Patent
Corso

(10) Patent No.: US 11,585,617 B2
(45) Date of Patent: Feb. 21, 2023

(54) HYBRID FIREARM MAGAZINE FOLLOWER

(71) Applicant: Steven Corso, Cody, WY (US)

(72) Inventor: Steven Corso, Cody, WY (US)

( * ) Notice: Subject to any disclaimer, the term of this patent is extended or adjusted under 35 U.S.C. 154(b) by 0 days.

(21) Appl. No.: 17/541,958

(22) Filed: Dec. 3, 2021

(65) Prior Publication Data

US 2022/0178633 A1 Jun. 9, 2022

Related U.S. Application Data

(60) Provisional application No. 63/120,873, filed on Dec. 3, 2020.

(51) Int. Cl.
*F41A 9/70* (2006.01)
*F41A 9/69* (2006.01)

(52) U.S. Cl.
CPC . *F41A 9/70* (2013.01); *F41A 9/69* (2013.01)

(58) Field of Classification Search
CPC ..... F41A 9/65; F41A 9/70
USPC ..... 42/49.01, 50
See application file for complete search history.

(56) References Cited

U.S. PATENT DOCUMENTS

| | | | | |
|---|---|---|---|---|
| 431,410 | A * | 7/1890 | Speed | F41A 9/65 42/50 |
| 2,944,357 | A * | 7/1960 | Smith | F41A 9/70 42/50 |
| 4,446,645 | A | 5/1984 | Kelsey, Jr. et al. | |
| 6,560,907 | B1 | 5/2003 | Vieweg | |
| 9,170,062 | B2 | 10/2015 | Corso | |
| 10,228,202 | B2 * | 3/2019 | Jarboe | F41A 9/71 |
| 2016/0076840 | A1 * | 3/2016 | Leimer | F41A 9/65 42/50 |

FOREIGN PATENT DOCUMENTS

| | | | | |
|---|---|---|---|---|
| GB | 508134 A * | 6/1939 | | F41A 9/70 |

* cited by examiner

*Primary Examiner* — Reginald S Tillman, Jr.
(74) *Attorney, Agent, or Firm* — Malloy & Malloy, P.L.; Robert M. Downey

(57) ABSTRACT

A follower for use in a variety of firearm magazines includes a follower body formed of a rigid material and having a bullet engaging surface that is contoured to position the bullets in the magazine so that they are efficiently stacked upon loading. The follower body further includes a rear leg that extends downward from a main generally horizontal surface and a slide lock shelf on one side. A flat follower spring is attached to a bottom of the follower body at one end and has a generally curved shape when in a relaxed state.

7 Claims, 4 Drawing Sheets

HYBRID FIREARM MAGAZINE FOLLOWER

This non-provisional patent application is based on provisional patent application Ser. No. 63/120,873 filed on Dec. 3, 2020.

BACKGROUND OF THE INVENTION

Field of the Invention

The present invention relates to followers used in firearm magazines and, more particularly, a follower that accommodates a variety of magazine types while allowing for a very short profile so that minimum space is used for follower height in order to provide the most volume in the firearm magazine for bullet capacity.

Description of the Related Art

Automatic and semi-automatic firearms usually contain a cartridge magazine in which bullets are stored. Firearm magazines are generally comprised of a housing, a magazine spring, and a follower. The magazine is designed to automatically load the bullets into position so that each bullet can be individually and sequentially stripped and loaded into the chamber following each time the firearm cycles and, in many instances, to also activate the slide lock lever after the last bullet in the magazine is fired. The magazine housing contains the bullets and the magazine spring forces the follower up to keep the next bullet located at the top of the magazine where it can be effectively stripped and chambered. The magazine housing may be of two different common types. In one type, the entire depth of the magazine housing is just slightly larger in width than the bullet diameter so that the bullets are loaded within the magazine directly on top of one another. This is known as a "single stack" magazine. In another type, the magazine housing is wider so that the bullets are stacked in two vertical columns next to each other. The bullets in this type of magazine are arranged when loaded so that the bullets axis are not directly next to each other, but so that the axis of the bullets on one side align horizontally with the tangential meeting point of the bullets in the column next to it. In pistol applications, this type of magazine is similar to the width of a single stack magazine at the very top, but tapers out to become wider and maintains this consistently wider dimension all the way down to the bottom of the magazine housing. The follower fits tight to the width of the magazine housing at the top where it is narrow and fits much more loosely side to side toward the bottom where the magazine tube gets wide. This type of magazine is dimensionally wider, but contains much higher capacity than the single stack magazine within a similar height range. This type of magazine is known as a "double stack". Unlike in single stack magazines, where followers can usually be flat on the top surface for reliable operation, double stack magazines require the top of the follower to be of a shape that will guide the first round into position toward one side of the magazine when loaded. This is so that the bullet positions alternate from side to side consistently each time the magazine is loaded. Also, since the first two bullets loaded into the magazine and in engagement with the follower end up at different horizontal heights within the magazine, the top of the follower should be shaped so that it maintains its position under the bullets as the magazine housing gets much wider than the follower toward the bottom. This type of follower often has a concave shape matching the radius of the bullet so it can wrap around the first bullet(s) that are loaded into the magazine for positioning.

The follower design can have a direct effect on magazine capacity given a fixed magazine size. Followers that have a long leg length or leg lengths create wasted space within the magazine due to the fact that they take up more vertical space. Ideally, the length of the legs on a follower should be no longer than the height of the magazine spring when the magazine is fully loaded and the spring is fully compressed. Modern spring designs that accomplish a shorter compressed spring height present a challenge due to the leg length(s) of the typical follower.

Also, the legs of the follower reduce the potential size of the magazine spring since the spring fits between the follower legs as it compresses. There have been examples of followers that eliminate the front leg. In these applications the front to rear length of the spring can be extended into the area where that front leg would have otherwise resided. Additional spring material would increase the length and or the force of the spring per coil which ultimately would allow fewer coils. It may also allow a thinner spring material. Fewer coils and thinner material equals shorter compressed height of the spring. When the compressed height of the spring is reduced, there is more room in the magazine for additional ammunition.

It is generally unacceptable for the front of the follower to tilt downward within the magazine, as this would allow the nose of the feeding bullet to dive causing a failure of the weapon. The control to prevent the front of the follower from pivoting down in a typical magazine is accomplished by interferences at the lowest point of contact between the rear leg of the follower with the rear inside surface of the magazine housing and at the highest point of contact between the front of the follower and the inside front surface of the magazine housing. If the vertical distance between these two points of contact are too short, the follower may be subject to binding or it may not prevent tilting at all.

Three prior examples of followers that should be referred to for the purpose of comparison are Kelsey (U.S. Pat. No. 4,446,645), Vieweg (U.S. Pat. No. 6,560,907), and Corso (U.S. Pat. No. 9,170,062). Each of these followers are, in practice, actually used in single stack type magazines. They are all made from a single piece of material, contain a rear leg only (no front leg), have a significant limit to how short that rear leg can be, have a limited ability to shape the top surface to effectively engage with the bullets in a double stack magazine, and are limited in the ability to optimize the spring force created by their compression. For a clearer presentation of these points, some elaboration is necessary: The length of the rear leg as described earlier, contributes to keeping the front of the follower from tilting downward. All of the mentioned examples have a contact point between the front of the follower and the front inside of the magazine well below the forward tip of the bullet. Corso '062 improves this by adding a flange extending up from the front of that lower follower surface which raises the contact point, but there are limits to the length this flange can be or it will interfere with the bullet when compressed. This low point of contact requires the rear leg of the follower to be longer than if that forward contact point was higher relative to the bullet to prevent tilting or binding of the follower. Since all of the mentioned examples are formed from a single piece of material that must have spring properties in order to work, they have a practical limit in their ability to be shaped on the bullet engaging surface, as would be necessary in a double stack magazine. Also, the spring force to compress the follower is restricted within a range of what can be accomplished with the type and thickness of the material necessary for the bullet engaging surface since it is all one material. Further, it should be mentioned that in the example of Kelsey '645, the follower actually loses contact with the front inside surface of the magazine when the magazine is empty as the lower horizontal shelf of the follower rises above the front edge of the magazine housing. This issue is solved in the Vieweg '907 and Corso '062 examples as is desirable. Features of the Vieweg and Corso design contain the follower from excessive front to rear movement when the magazine is empty as should be accomplished with any new follower design.

Given the current limitations in the related art, there is a need for a follower with a single short leg length, a complex bullet engaging surface geometry, and further wherein the follower has a built-in spring with properties that are not limited by the material or manufacturing method of the bullet engaging portion, to thereby provide a lower profile that allows maximum magazine bullet capacity in box magazines, including double stack magazines.

SUMMARY OF THE INVENTION

The present invention is directed to a firearm cartridge magazine follower designed to allow the lowest possible profile in order to accommodate maximum storage capacity for bullets in all types of box magazines including single and double stack variations. This is accomplished by combining two parts as an assembly. The main body of the follower is of a complex shape in order to congruently engage at least the first bullet loaded in the magazine. The main body is also formed to include a rear leg which rides along the rear inside surface of the magazine housing to prevent the front end of the follower from tilting downward in the magazine. Finally, the main body of the follower is formed to include a slide stop shelf. The follower body is made of a material and process specific to its requirements. The other part acts as a spring and is made of a material and using a manufacturing process specific to its requirements. The follower spring attaches permanently to the follower body combining as one. When the magazine contains bullets, an upper point of the front of the follower body contacts the front inside wall of the magazine housing. This point of contact at the front can be higher than the lowermost part of the engaging bullet so that the shortest rear leg possible can be used, while still preventing the follower from tilting forward or binding. In the condition of an empty magazine not installed in a weapon, where the follower resides at its upper vertical limit, the follower spring acts as a front leg of the follower to keep it securely located within the magazine housing and from moving forward beyond the front surface of the magazine housing or from tilting up and out of the magazine housing. As the magazine is loaded, the follower spring flattens between the follower body and the magazine spring until the follower spring is flat or near flat, thereby yielding valuable space under the follower for the magazine spring when the magazine is full to capacity and the follower is located at its lowest point of travel.

In another embodiment of the invention, the follower is structured to provide for a lower slide stop shelf. In this embodiment, the follower includes a separate piece that is fixed to the bottom of the follower body, between the follower body and the follower spring. More specifically, a sprung slide lock shelf, preferably made of a material with spring properties and in the form of a thin flat strip, is attached at the rear of the follower body, on the bottom side, between the follower body and the follower spring. The sprung slide lock shelf includes a shelf area that protrudes from the side of the follower body, much like the location of the slide lock shelf in the previous embodiment. The sprung slide lock shelf allows for a lower slide lock shelf location on the follower, while compressing to a much shorter vertical profile when the magazine is full, thereby providing more space for bullets in the firearm magazine.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

Figure 1:
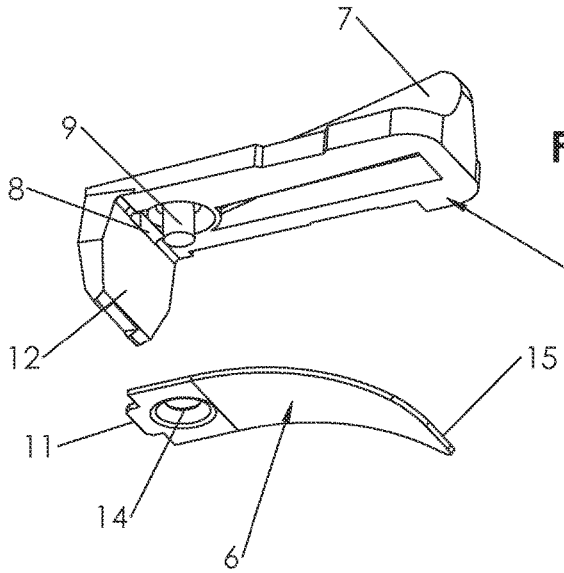
FIG. 1 is a partially exploded bottom perspective view of an unassembled follower in accordance with one embodiment of the invention.
Figure 2:
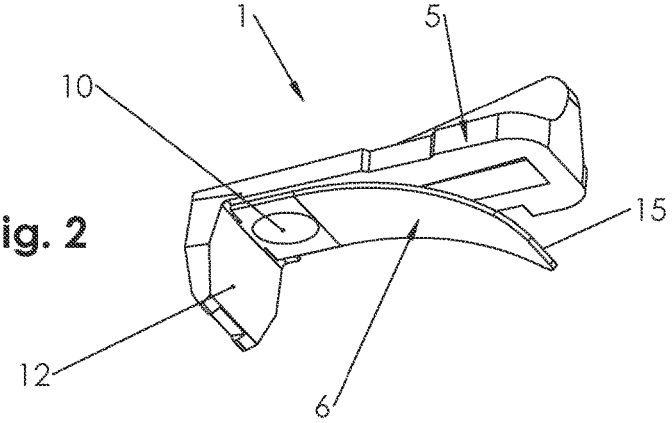
FIG. 2 is a bottom perspective view of the follower of FIG. 1, shown fully assembled.
Figure 3:
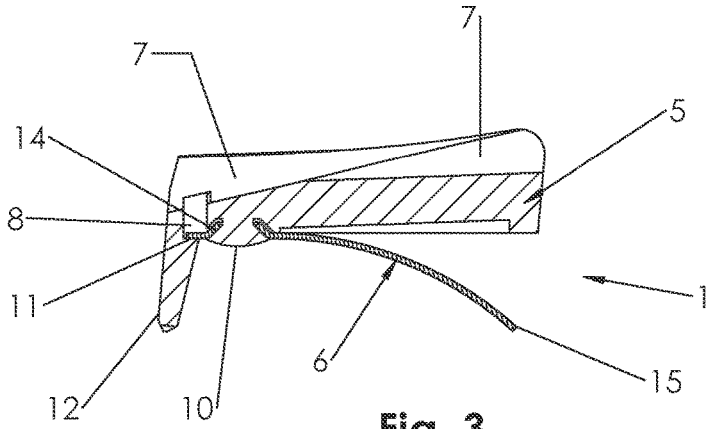
FIG. 3 is a side view, shown in cross-section, of the assembled follower.
Figure 4:
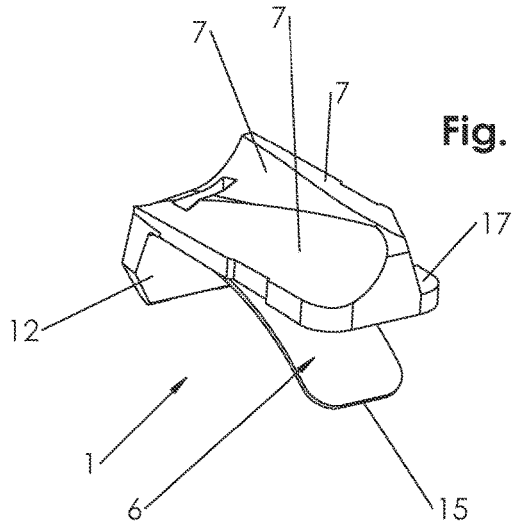
FIG. 4 is a top perspective view of the assembled follower.
Figure 5:
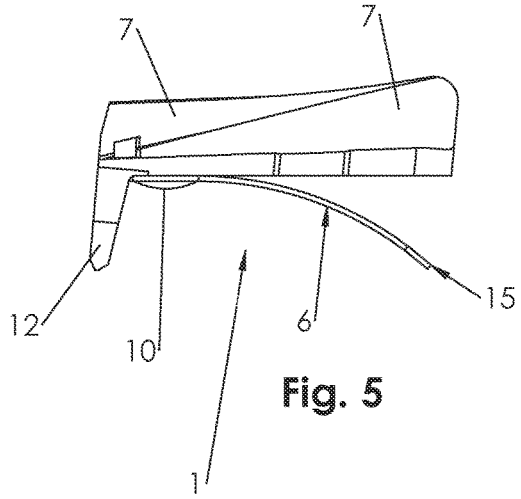
FIG. 5 is a side elevational view of the assembled follower.
Figure 6:
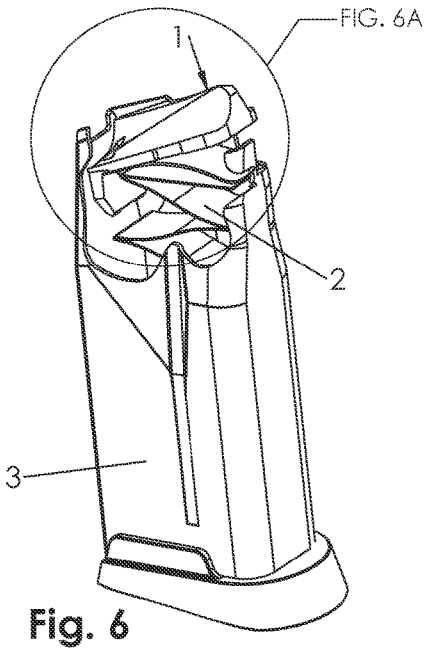
FIG. 6 is a perspective view, shown in partial cutaway, of an assembled magazine unloaded.
Figure 6A:
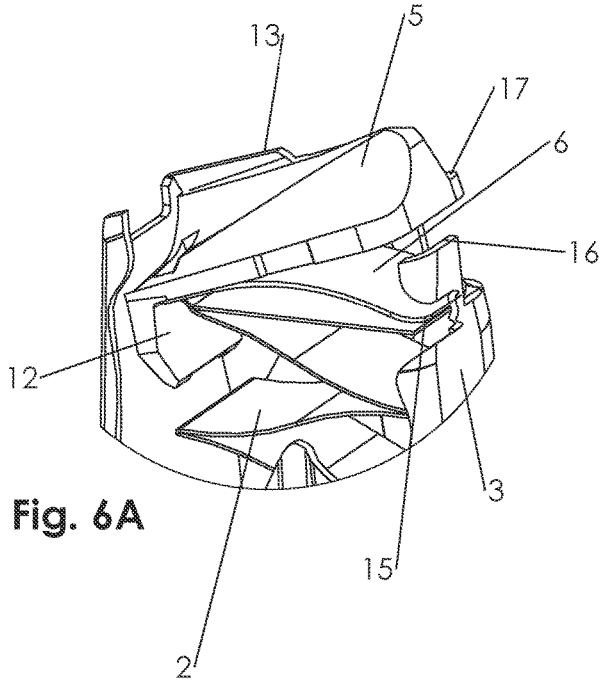
FIG. 6A is a magnified view taken from the area indicated as FIG. 6A in FIG. 6.
Figure 7:
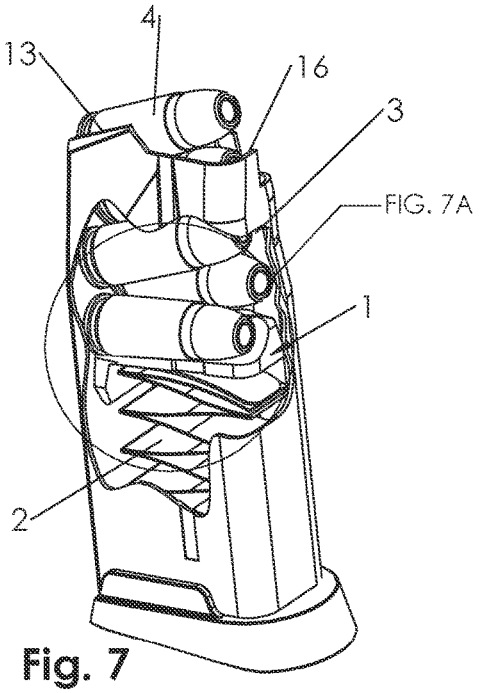
FIG. 7 is a perspective view, shown in partial cutaway, of an assembled magazine partially loaded.
Figure 7A:
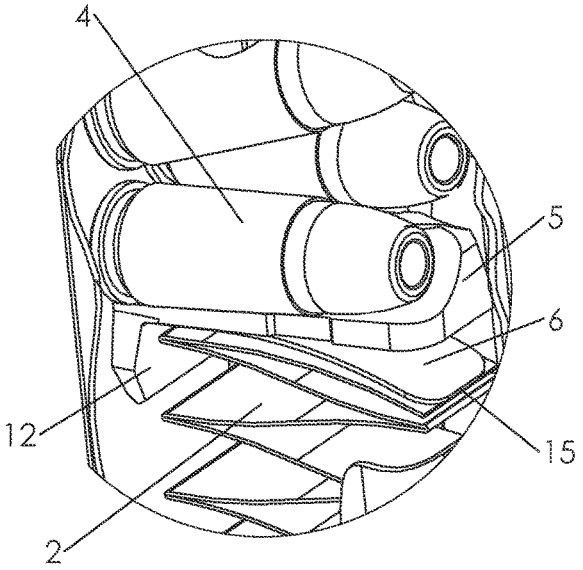
FIG. 7A is a magnified view taken from the area indicated as FIG. 7A in FIG. 7.

| General Parts Description | |
|---|---|
| 1 | Follower |
| 2 | Magazine Spring |
| 3 | Magazine Housing |
| 4 | Bullet |
| 5 | Follower Body |
| 6 | Follower Spring |
| 7 | Bullet Engaging Surface |
| 8 | Receiving Slot |
| 9 | Mounting Post |
| 10 | Swaged Post |
| 11 | Support Tab |
| 12 | Rear Leg |
| 13 | Feed Lips |

-continued

| General Parts Description | |
|---|---|
| 14 | Countersunk Hole |
| 15 | Forward End Tip |
| 16 | Upper Front Edge |
| 17 | Slide Lock Shelf |
| 1a | Follower Of Second Embodiment |
| 5a | Follower Body Of Second Embodiment |
| 18 | Sprung Slide Lock Shelf |
| 19 | Hook On The Sprung Slide Lock Shelf |
| 20 | Shelf Area On The Sprung Slide Lock Shelf |
| 21 | Enlarged Rear Portion Of The Sprung Slide Lock Shelf |
| 22 | Open Aperture In The Enlarged Rear Portion Of The Sprung Slide Lock Shelf |
| 23 | Slot Formed In Front End Of Follower Body |
| 24 | Shoulder Within Slot In Front End Of Follower Body |

DETAILED DESCRIPTION OF THE PREFERRED EMBODIMENTS

Referring to FIGS. 1-8 of the drawings, one embodiment of the hybrid firearm magazine follower of the present invention is shown and is generally indicated as 1. The hybrid magazine follower 1 is comprised of two separate components assembled together as one finished part. One component, the follower body 5, is of rigid structure with a complex detailed shape that is manufactured using a process capable of such results including plastic injection molding. The follower body 5 engages with the first bullet(s) 4 that is loaded into the magazine 3 (see FIGS. 7-8A) with its bullet engaging surface 7 (see FIGS. 1-6A) that is contoured to position the bullets in the magazine so that they are stacked upon loading in a precise and consistent manner. The bullet engaging surface 7 of the follower body 5 may also be contoured as a negative (i.e., congruent) match of the shape of the first bullet(s) 4 into the magazine 3 in such a way that, under the force of the magazine spring 2, it is kept in a specific and precise location as the magazine 3 gets wider toward the bottom where the follower 1 loses its influence of the magazine side walls as is common in double stack type magazines. The follower body 5 includes the rear leg 12 which extends downward from the main generally horizontal surface of the follower body 5. A slide lock shelf 17 is built into the shape of the follower body 5. There are also provisions built into this part for mounting the second component together with the follower body 5. In at least one embodiment, there is a mounting post 9 and a receiving slot 8 for this purpose (see FIGS. 1 and 3).

The second component of the follower 1 assembly is the follower spring 6 (see FIGS. 1-3) which is suitable to be cut and formed from flat material containing the appropriate spring properties for the application. The follower spring 6 is formed to be of a generally curved shape and is assembled to the follower body 5 using an appropriate method. In the preferred embodiment, the follower spring 6 contains support tab 11 and a countersunk hole 14, both of which are features used to mount the follower spring 6 to the follower body 5.

During assembly, the follower spring 6 is located onto the underside of the follower body 5 so that the mounting post 9 is inserted into the countersunk hole 14 with the follower spring 6 positioned so that the open end of the countersunk hole 14 is directed away from the follower body 5 and the forward end tip 15 of the follower spring 6 is located away from the follower body 5 as a result of its curved shape. The follower spring 6 is manipulated so that the support tab 11 enters the receiving slot 8. The mounting post 9 would then be swaged to permanently contain the follower spring 6 onto the follower body 5 so that the swaged post 10 (see FIGS. 2-3) is recessed into the countersunk area of the follower spring 6, and so that there is little or no material of the swaged post 10 exceeding the bottom surface of the follower spring 6. As permanently attached, the follower body 5 and the follower spring 6 represent the follower 1 of the preferred embodiment.

When the follower 1 is assembled within a complete magazine that is empty without bullets 4, the front of the follower body 5 may completely exceed the upper front edge 16 of the magazine housing 3 vertically. When the follower 1 is in this position, the force of the magazine spring 2 upon the follower spring 6 is not enough to compress the follower spring 6 significantly. The forward end tip 15 of the follower spring 6, therefore, will remain below the upper front edge 16 and against the inside surface of the magazine housing 3. With the follower spring 6 in its uncompressed and curved state while positioned at the top of the magazine, it acts much like a follower front leg would in keeping the follower from moving forward and maintaining containment within the magazine housing 3. Also, in the event that the front of the follower body 5 is pushed upward when the follower 1 is in this position, urging the follower 1 to pivot on the front edges of the magazine feed lips 13, the interference between the forward end tip 15 of the follower spring 6 and the inside surface of the magazine housing 3 would cause the follower 1 to resist this motion.

When bullets 4 are added to the magazine 1, the follower will position itself under the stack according to the contour design of the bullet engaging surface 7. The contour design of the bullet engaging surface 7 would also be responsible for locating the first bullet 4 loaded in the magazine into its appropriate position (often to one specific side) so that the following bullets loaded would stack as desired. As more bullets 4 are loaded, the follower spring 6 compresses into a more flat position and the upper front surface of the follower body 5 comes into contact with the inside front surface of the magazine housing 3 while the rear bottom edge of the rear leg 12 maintains contact with the rear inside surface of the magazine housing. These contact points of the follower body 5 are what keep the front of the follower 1 from tilting down and causing a problem. The forward end tip 15 of the follower spring 6 has no influence on the prevention of this motion, as is the case in some follower examples of the prior art. Since the front point of contact between the follower 1 the magazine housing 3 end up much higher in this design, the rear leg can be much shorter than if it were the much lower front end tip 15 that accomplished the anti-tilt interference at the front.

Figure 8:
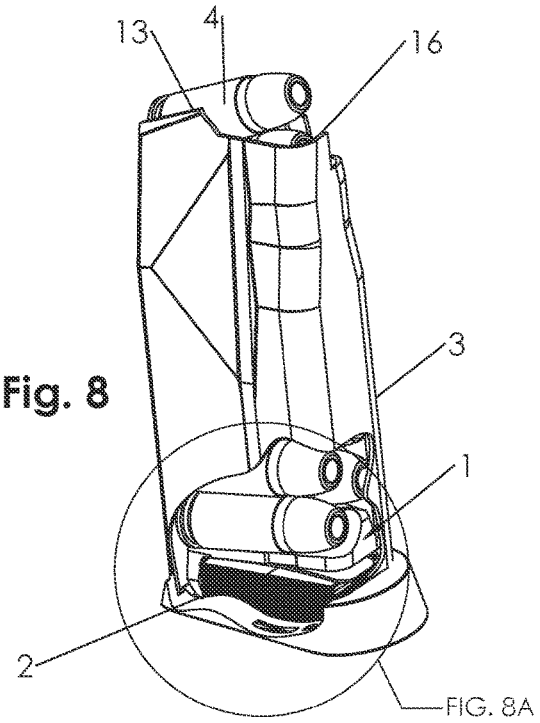
FIG. 8 is a perspective view, shown in partial cutaway, of an assembled magazine fully loaded to capacity.
Figure 8A:
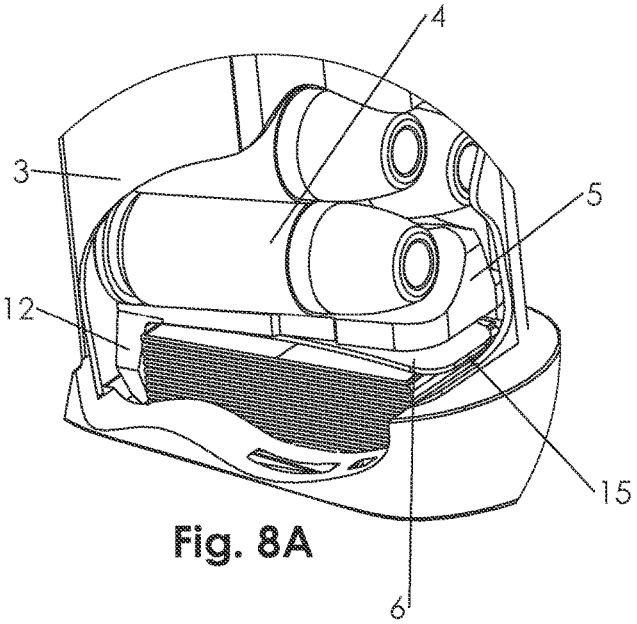
FIG. 8A is a magnified view taken from the area indicated as FIG. 8A in FIG. 8.
Figure 9:
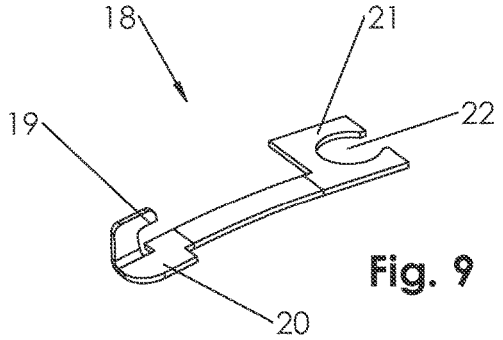
FIG. 9 is a top perspective view of a sprung slide lock shelf used in accordance with a second embodiment of the follower of the present invention.
Figure 10:
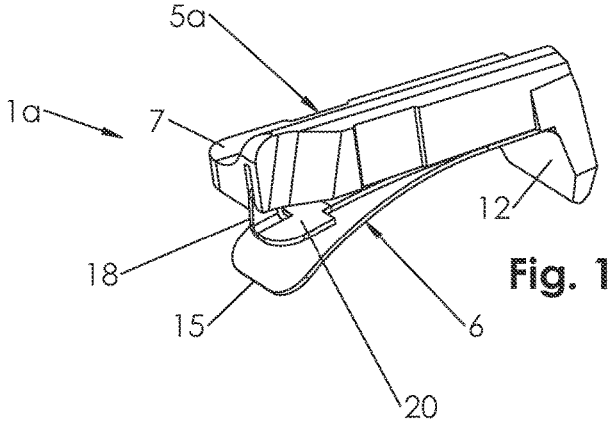
FIG. 10 is a top perspective view of an assembled follower including the sprung slide lock shelf of FIG. 9, in accordance with the second embodiment of the present invention.

When the magazine is fully loaded with bullets 4, the magazine spring 2 is fully compressed, and the follower 1 is at its lowest position, the follower spring 6 is compressed to a flat or nearly flat shape (see FIGS. 8-8A). As the bullets 4 are stripped from the magazine and the follower 1 makes its way up toward the top of the magazine housing 3, the influence of the force of the magazine spring 2 on the follower spring 6 is reduced and the follower spring 6 gradually regains its curved shape until it is fully realized when it reaches the top of the magazine housing 3.

Figure 11:
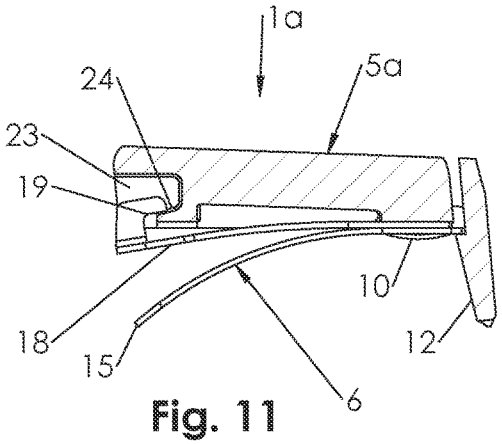
FIG. 11 is a side elevational view, in partial cross section, showing the assembled follower of FIG. 10.
Figure 12:
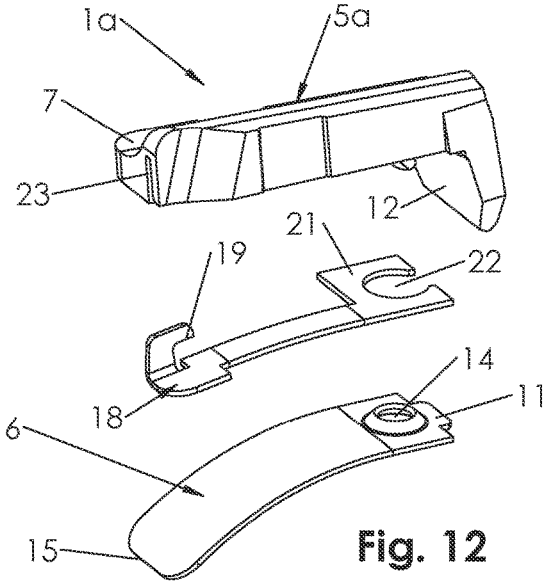
FIG. 12 is an exploded top perspective view of the follower of FIG. 10, in accordance with the second embodiment of the invention.

A further embodiment of the hybrid firearm magazine follower of the invention is shown in FIGS. 9-12 wherein the hybrid firearm magazine follower is generally indicated as 1*a*. This embodiment provides for a variation of the slide stop shelf. More particularly, there are some instances, depending on the firearm, where the slide stop shelf may need to be located lower on the follower than it is in the embodiment of FIGS. 1-8, as described above. In order to accommodate a lower slide stop shelf, the follower body would need to grow in thickness which would lessen the benefit of the present invention since the follower would need to grow in height. This would result in the follower taking up more vertical space in the magazine housing 3, which is inconsistent with the purpose of the invention. In order to accommodate a lower slide stop shelf with little or no effect on overall follower 1*a* vertical thickness (i.e., height), a sprung slide lock shelf 18 may be captured between the follower body 5*a* and the follower spring 6. In this embodiment, the slide stop shelf 17 shown in FIGS. 1-8 is eliminated from the follower body 5 and is functionally replaced with the sprung slide lock shelf 18. The sprung slide lock shelf 18 is preferably made of a material with spring properties so that it returns to its original shape after deflecting. The shape and structure of the sprung slide lock shelf 18 is a generally thin flat strip with a hole or other feature allowing it to be attached at the rear of the follower body 5*a*, as seen in FIG. 11. The sprung slide lock shelf 18 further includes a shelf area 20 that protrudes from the side of the follower body 5 when assembled, and a flange containing a hook 19 which engages the follower body 5*a* and is used to limit its downward travel.

In operation, the sprung slide stop shelf 18 contacts the slide lock arm (not shown) within the firearm, thereby activating the slide stop condition. There is no downward movement of the sprung slide stop shelf 18 relative to the follower body 5*a* when this happens since the hook 19 is engaged with shoulder 24 within slot 23 formed in the front end of the follower body 5*a* and prevents the sprung slide lock shelf 18 from deflecting in the downward direction. When the magazine is filled to capacity and the follower bottoms out inside the magazine housing 3, the sprung slide stop shelf 18 deflects upward against the follower body 5*a* so that maximum vertical space is allowed above the follower 1 in a loaded magazine. In summary, the sprung slide lock shelf 18 allows for a lower slide lock shelf location on the follower 1*a* while compressing to a much shorter vertical profile when the magazine is full, thereby providing more space for bullets in the firearm magazine.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A follower for use in a firearm magazine that holds multiple bullets, the follower comprising:

a follower body formed of a rigid material and including a front end, a back end, a top side and a bottom, the top side including a bullet engaging surface that is formed and configured for receipt of a first one of the bullets loaded into the magazine, and the follower body further including a slide lock shelf on one side of the follower body, and a rear leg extending downwardly from the follower body at the back end, and the rear leg terminating at a bottom and including a back rear edge; and a follower spring formed of a flat material and having spring biased properties, and the follower spring including a top side, a bottom side, a rear portion and a front portion including a front edge, and the rear portion of the follower spring fixed to the follower body with the follower spring positioned below the bottom of the follower body, and the follower spring curving downwardly from the rear portion to the front portion so that at least a portion of the top side of the follower spring is separated from the bottom of the follower body when the follower spring is in a relaxed state, and the follower spring being movable against the bottom of the follower body in a compressed state when a force is applied to the bottom side of the follower spring.

2. The follower as recited in claim 1 wherein the bullet engaging surface of the follower body is structured to contact the first one of the bullets loaded into the magazine in a manner that influences the first one of the bullets into a precise position that causes subsequently loaded bullets to be stacked in a space efficient manner within the magazine.

3. A follower for use in a firearm magazine that holds multiple bullets, the follower comprising:

a follower body formed of a rigid material and including a front end, a back end, a top side and a bottom, the top side including a bullet engaging surface that is formed and configured for receipt of a first one of the bullets loaded into the magazine, and the follower body further including a rear leg extending downwardly from the follower body at the back end, and the rear leg terminating at a bottom and including a back rear edge; and a follower spring formed of a flat material and having spring biased properties, and the follower spring including a top side, a bottom side, a rear portion and a front portion including a front edge, and the rear portion of the follower spring fixed to the follower body with the follower spring positioned below the bottom of the follower body, and the follower spring curving downwardly from the rear portion to the front portion so that at least a portion of the top side of the follower spring is separated from the bottom of the follower body when the follower spring is in a relaxed state, and the follower spring being movable against the bottom of the follower body in a compressed state when a force is applied to the bottom side of the follower spring.

4. The follower as recited in claim 3 wherein the follower body further includes a slide lock shelf on one side.

5. The follower as recited in claim 4 wherein the bullet engaging surface of the follower body is structured to contact the first one of the bullets loaded into the magazine in a manner that influences the first one of the bullets into a precise position that causes subsequently loaded bullets to be stacked in a space efficient manner within the magazine.

6. The follower as recited in claim 3 further including a sprung slide lock shelf formed of a thin flat strip material and attached to the follower body and positioned between the bottom of the follower body and the follower spring and including a top side, a bottom side, a rear portion and a forward portion, and the sprung slide lock shelf further including a shelf member protruding from one side and positioned outboard of the follower body.

7. The follower as recited in claim 6 wherein the follower body includes a slot formed in the front end and a shoulder member within the slot; and the sprung slide lock shelf including a hook member extending upwardly from the forward end and received within the slot formed in the front end of the follower body, and the hook member being positioned for engagement with the shoulder member to prevent the sprung slide lock shelf from deflecting in the downward direction relative to the bottom of the follower body.

* * * * *